United States Patent [19]

Saukkonen et al.

[11] Patent Number: 4,921,183

[45] Date of Patent: May 1, 1990

[54] METHOD AND DEVICE FOR THE REELING OF A WEB

[75] Inventors: Seppo Saukkonen, Vantaa; Kauko Tomma, Helsinki; Vesa Raudaskoski, Järvenpää, all of Finland

[73] Assignee: Valmet Paper Machinery Inc., Finland

[21] Appl. No.: 197,035

[22] Filed: May 20, 1988

[30] Foreign Application Priority Data

May 20, 1987 [FI] Finland ..... 872225

[51] Int. Cl.[5] ..... B65H 18/16; B65H 18/02; B65H 18/20; B65H 18/22

[52] U.S. Cl. ..... 242/66; 242/56 R; 242/68.7

[58] Field of Search ..... 242/57, 75.1, 75.2, 242/67.1 R, 66, 56 R, 65, 75.5, 75.51, 68.7

[56] References Cited

U.S. PATENT DOCUMENTS 4,150,797 4/1979 Kataoka ..... 242/75.2 X
4,746,076 5/1988 Tomma et al. ..... 242/66

FOREIGN PATENT DOCUMENTS 3627533 2/1988 Fed. Rep. of Germany ..... 242/75.1
0124642 7/1984 Japan ..... 242/57

*Primary Examiner*—John Petrakes
*Attorney, Agent, or Firm*—Steinberg & Raskin

[57] ABSTRACT

Method and device for the reeling of a web. The web is reeled by supporting an outer circumference of the roll being formed with at least two supporting units. A first such unit in a direction of arrival of the web is a carrier roll provided with a mechanical rotating drive over which the web is passed to reeling. The carrier roll forms a reeling nip supporting the roll from below. A press roll is situated above the roll being formed so that the roll being wound is stably maintained in reeling position. The roll is wound about a core in a nip support between the carrier roll, a belt roll, and the upper press roll. When the roll is wound and increased, the reeling continues the nip support by the carrier roll and the upper press roll, and additionally, on a belt supporting zone situated as a direct extension of the support zone of the belt roll. The final stages of the reeling are carried out up to a full roll by extending the belt support zone and, at the same time, by adjusting tensioning of the supporting belt or belts so that the linear loads in the various supporting nips of the roll remain within suitable limits in view of progress of reeling and of quality of the roll so being wound.

19 Claims, 5 Drawing Sheets

METHOD AND DEVICE FOR THE REELING OF A WEB

BACKGROUND OF THE INVENTION

The present invention concerns a method in the reeling of a paper web or equivalent, in which the web is reeled by supporting the rolls to be formed on its circular, cylindrical outer circumference by means of at least two supporting members of which the first one, in the direction of arrival of the web, is a driven carrier roll with the web being passed to reeling over a sector thereof. Furthermore, this carrier roll forms a reeling nip supporting the roll being wound from below. A press member, preferably a press roll, is used above the roll being wound, by means of which the roll being wound is maintained stably in reeling position.

The present invention further concerns a reel-up mechanism for a paper web or equivalent, including at least two supporting units of which the first one in the direction of arrival of the web, is a carrier roll provided with a mechanical rotating drive, with the web being passed to reeling over a sector thereof. This carrier roll forms a reeling nip supporting the roll from below. This reeling-up mechanism also includes a press member unit, preferably a press roll unit, by means of which the reeled-up web roll is stably maintained in reeling position.

With respect to prior art related to the present invention, references is made to the following patents and applications: U.S. Pat. Nos. 3,098,619; 3,346,209; 4,456,190; 4,485,979; 4,485,980; GB Pat. Appl. No. 2,142,909; German Offen. DE-OS No. 3,121,039; Finnish Pat. No. No. 49,276; and Finnish Patent Applications Nos. 843184 and 844652.

In the forming of paper rolls reeled up while being supported on the circumference thereof, there has been a problem of internal damage in the large and heavy rolls reeled up. Damage is produced, in particular, underneath the surface layer of the reeled-up roll. Some of the most common damage results in crepe wrinkles in a transverse direction of the web, and in web cracking The principal cause of damage has been ascertained to be an excessively high nip pressure between the paper roll being wound and the carrier roll, resulting from the weight of the paper roll or from an excessive press-roll load.

In order for a roll of good quality to be obtained by means of a carrier-roll reel-up, it has been noted that the linear load between the paper roll being wound and the carrier roll should be about 1 to 4 kN/m. Within this range of linear load, it is possible, as a rule, to accomplish desired distribution of tension in the roll.

When a carrier roll of short radius is used, the above range of linear load is exceeded at the final stage of the reeling with large paper rolls so wound, whereby the contact pressure rises to a level greater than that tolerated by a printing-paper roll. This results from the narrow nip area between the paper roll and the carrier roll. In a manner known in the prior art, attempts have been made to eliminate this problem by making the carrier roll larger, which increases the cost of manufacture and operation of the reel-up.

A soft-faced carrier roll is known from Finnish patent application No. 843,184, in which the nip face becomes larger. However, a drawback in this arrangement is the dynamic problem of formation of two faces, as well as the generation of heat during the reeling.

Attempts have also been made to solve these problems by dividing the load on carrier rolls of different sizes or on inclined carrier rolls. Distribution of the load between rolls does not reduce the maximum pressure, but it increases the pressure between one of the carrier rolls and the paper roll, depending on the diameters and on the inclinations. The most uniformed distribution of the roll pressure is obtained with equally large carrier rolls situated symmetrically underneath the paper roll, by using the construction known from U.S. Pat. No. 4,456,190.

SUMMARY OF THE INVENTION

Accordingly, it is a principal object of the present invention to provide for reeling-up of a web such as a paper web with support on the circumference thereof, by means of which a paper web roll as good as possible is obtained. In other words, it is an object to obtain a roll without reeling defects and with a desired distribution of density as a function of the roll diameter.

It is a further object of the present invention to provide for increase in diameter and weight of rolls being reeled up, if necessary, as compared to rolls made by means of prior-art reel-ups with support along the circumference thereof.

These and other objects are attained by the present invention which is directed to a method for reeling a web into a roll, comprising the steps of winding the web about a core between the same and a carrier roll and a belt roll to form a web roll being wound, continuing this winding of the web about the core between the same and the carrier roll, and additionally after the web wound upon the same reaches a certain radius, between the core and a belt supporting zone situated as a direct extension of the belt roll. The web may be passed over a sector of the carrier roll to the core, with the web roll being wound supported from underneath by the carrier roll and by the belt roll, and also after the web roll reaches the certain radius, by the belt supporting zone, along with the web roll being stabilizing in reeling position by winding the web about the core between the same and an upper press member which is preferably a press roll.

The winding of the web between the core and the belt supporting zone is preferably continued, whereby radius of the wound roll increases, the belt zone supporting the wound roll thereby increases, and tension of at least one belt defining the zone is thereby adjusted. Thus, linear loads in various supporting nips of the roll being wound remain within suitable limits with a view to progress of reeling and quality of the roll.

The present invention is also directed to apparatus for reeling up a web, comprising a carrier roll arranged for supporting a roll of the web as it is being wound, and a support unit arranged for supporting the roll of the web as it is being wound together with the carrier roll, with the support unit comprising a pair of belt rolls and at least one belt passing around the same and arranged to support, on an upper run thereof, the roll being wound after the roll increases past a certain radius in size. The carrier roll may be arranged to guide the web over a sector thereof and to a point where the web is being wound, and also to form a nip with the web roll being wound. A press member may be arranged to stabilize the web roll in position as it is being wound, this press member preferably comprising a press roll arranged above the web roll being wound. Means for adjusting tensioning of the at least one belt substantially in a direction of a plane passing through axes of rotation of the belt rolls, may also be provided.

Accordingly, with a view to achieving the objectives noted above and those which will become apparent below, the method of the present invention is principally characterized by the formation of a roll out of a web passed over a carrier roll and onto a core or equivalent, comprising a combination of the following steps:

(a) The roll is grown, i.e. produced and enlarged, around the core or equivalent under a nip support between the carrier roll, a belt roll, and an upper press member, which is preferably a press roll (FIG. 2A);

(b) When the roll grows and becomes larger than a certain radius, the reeling continues further under nip support between the carrier roll and the upper press member and, in addition to this nip support, on a belt supporting zone situated as a direct extension of the nip support zone of the belt roll (FIG. 2B); and (c) The final stages of reeling are carried out up to full radius of the roll in accordance with the preceding step (b) as the roll radius is increased and extends the belt support zone and, at the same time, adjusts the tensioning of the support belt (or belts), so that the linear loads in the various supporting nips of the roll remain within suitable limit values with a view to the progress of reeling and the quality of the roll.

Furthermore, a device in accordance with the present invention is principally characterized by a reel-up mechanism comprising a combination of:

(a) a belt support unit situated as a latter lower supporting unit in a direction of arrival of the web, by means of which the web is supported from below together with support by the carrier roll;

(b) the belt support unit including belt rolls, around which a carrier belt or carrier belts is/are fitted, an upper run of which supports the roll from below at least in the final stages of the reeling with larger web roll radii; and (c) the belt support unit including a power unit arrangement which is connected to be effective between the belt rolls, so as to adjust tensioning of the belt or belts, and to be effective substantially in a direction of a plane situated through axes of rotation of the belt rolls.

By means of a reel-up method and mechanism in accordance with the present invention, it is possible to produce a paper roll of higher quality which has no defects and has a density as desired, e.g. invariable. These advantages of the invention are achieved substantially by means of the new and improved method and belt-supporting device of the invention herein, in which support of the paper roll from underneath is regulated by adjusting tension of the belt or belts. This adjustment of tension is carried out in a manner such that it does not have a disturbing effect on the length of the support zone in the belt-supporting unit, or on the distribution of the support pressure.

BRIEF DESCRIPTION OF THE DRAWINGS

The present invention will be described in further detail below, with reference to certain exemplary embodiments of the present invention illustrated in the accompanying drawings, and to which the present invention is not intended to be strictly confined. In the drawings.

DESCRIPTION OF THE PREFERRED EMBODIMENTS

Figure 1A:
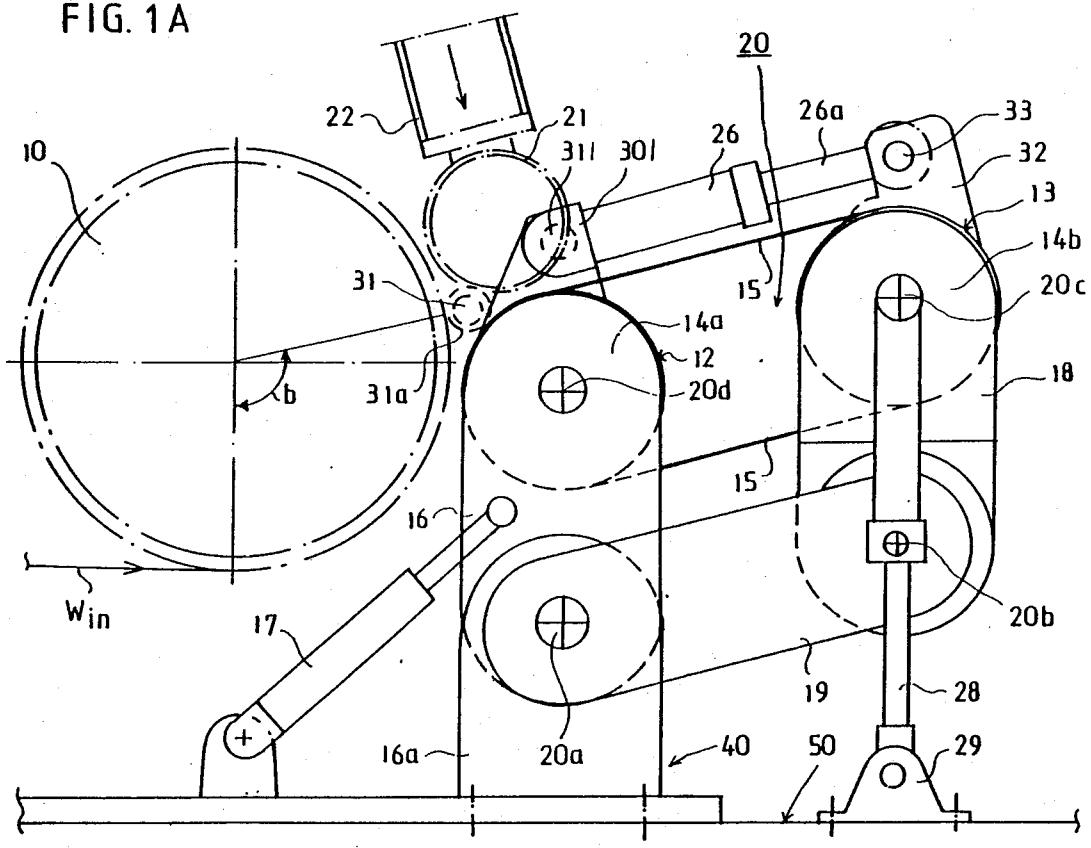
FIG. 1A is a side view of a reeling up of a web in accordance with the present invention, at an initial stage of 1 reeling.
Figure 1B:
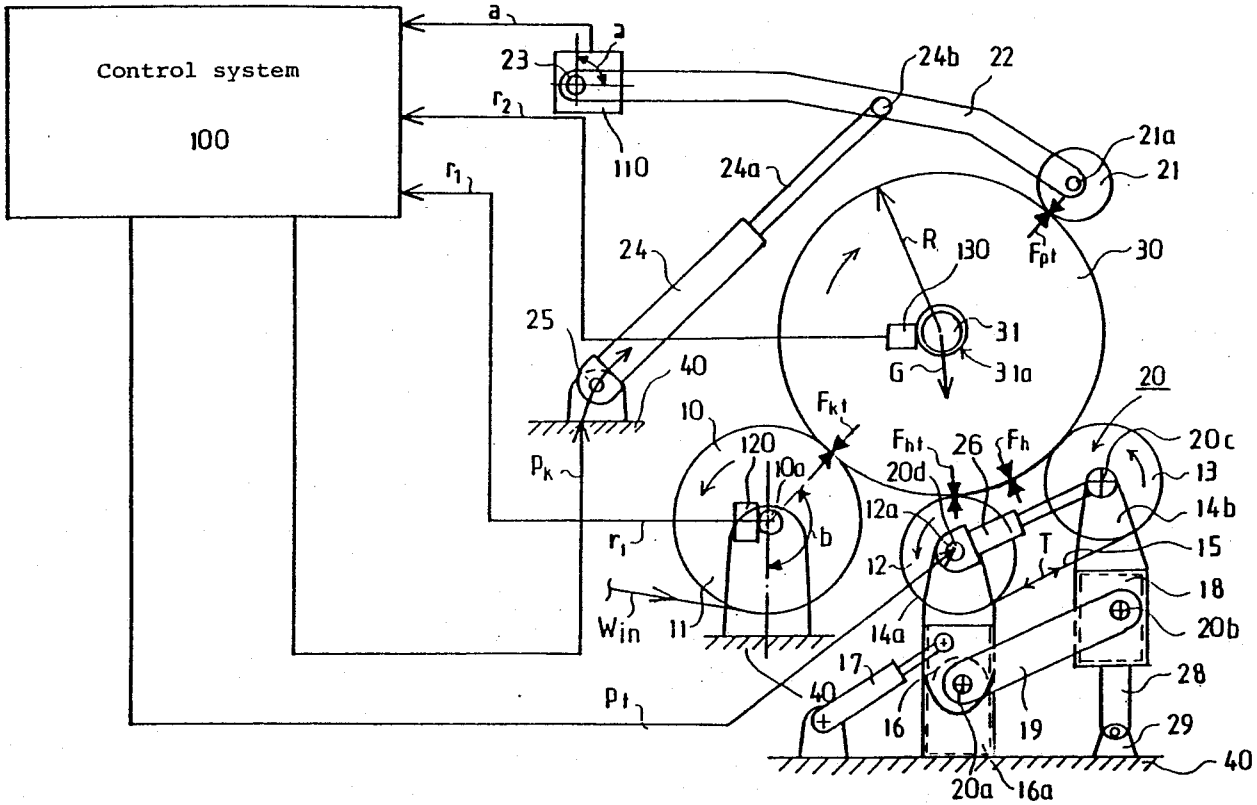
FIG. 1B is a schematic illustration of reeling-up in accordance with the present invention, and of procedure and technique for controlling the same at a final stage of reeling.

FIGS. 1A and 1B are schematic side view of certain advantageous, exemplary embodiments of the reeling-up of a web roll in accordance with the present invention. The reeling-up mechanism illustrated in FIGS. 1A and 1B comprises a rear carrier roll 10 which is provided with a mechanical rotating drive 10*a*, with the web W passed to reeling over a sector b thereof. The roll 10 is mounted by its axle journals on bearing supports 11 which are attached to a frame part 40 of the device which is only illustrated schematically. The reel-up mechanism further comprises a press roll 21 which may be provided with a drive 21*a*. The press roll is attached to arms 22, which are linked to the frame part 40 of the device permanently at an articulation point 23. The press roll 21 is loaded by cylinders 24 which are, at articulation points 25 thereof, attached to the frame part 40. Piston rods 24*a* of the cylinders 24 are attached to the arms 22 at articulation points 24*b*.

In addition to support by the carrier roll 10, the web roll 30 that is being formed is also supported from underneath by a belt support unit 20, and therein directly by an upper run of a carrier belt 15 which runs between belt rolls 12 and 13. The belt support unit 20 may comprise a single belt 15 or several belts placed side by side. The first belt roll 12 is provided with a rotation drive 12*a*. The roll 12 is mounted by its axle journals on supports 14*a* which are attached to an intermediate part 16. The intermediate part or member 16 is, through articulated joint 20*a*, attached to a part 16*a* which is supported on the frame part 40 or foundation 50. The parts 14*a*, 16 are pivoted around the articulated joints 20*a* by hydraulic cylinders 17.

The second belt roll 13 is mounted by its axle journals on supports 14*b* which are fitted in conjunction with an intermediate part or member 18. The intermediate parts or members 16 and 18 are interconnected by an arm 19 which is attached to said intermediate parts 16 and 18 by means of horizontal, articulated joints 20*a* and 20*b*. The bearing supports 14*a* and 14*b* on which the belt rolls 12 and 13 are journaled, are attached to the upper ends of the parts or members 16 and 18. Flange parts 301 and 32 are attached to the upper parts of the bearing supports 14*a* and 14*b*, between which an hydraulic cylinder 26 and a piston rod 26*a* are attached by means of link pins 311 and 33.

By means of the pair of hydraulic cylinders 26, the tension T of the belt or belts 15 is adjusted. The tensioning T of the belt or parallel belts in the belt support unit 20 is adjusted by shifting the opposite belt rolls 12, 13 relative to each other by means of power units 26, i.e. the hydraulic cylinders, having a direction of effort or effect substantially parallel to a principal direction of the run of the belt or belts 15 between the belt rolls 12, 13. The parts 16, 18, 19 and 26 form a pair of rhomboids, which are provided with the articulation points 20*a*, 20*b*, 20*c* and 20*d*. When the belt 15 is tensioned by extending the cylinder 26, 26*a*, pivoting takes place around the articulation points 20*b* and 20*c* as the articulated joint 20*a* is immobilized by the cylinders 17.

The positions of the belt rolls 12 and 13 are substantially fixed and the position of the belt roll 13 is altered in the direction of the run of the belt 15 between the rolls 12 and 13 by the effect of the cylinder 26 only to the extent that it is necessary to adjust the tensioning T of the belt 15 and to replace the belt 15. FIGS. 1A and 1B are schematic side views, and it is understood that for the support of the various rolls 10, 12, 13, 21, there are corresponding axle journals, supports, arms 22, cylinders 17, 24, 26 and 28, etc. also at the opposite side of the device or mechanism. Arm parts or members 19 included in the side frames of the belt support unit 20 in the reel-up mechanism or device are pivotably attached to a lower part of the intermediate part or member 16 by means of the horizontal joints 20*a*. These arm parts or members 19 are supported on the frame part 40 or foundation part 50 of the machine, by means of support arms 28, and preferably by means of power units, especially by means of hydraulic cylinders by which a latter part in the belt support unit 20(i.e. a part facing away from the carrier roll 10) and the upper belt roll 13 can be displaced.

Figure 3:
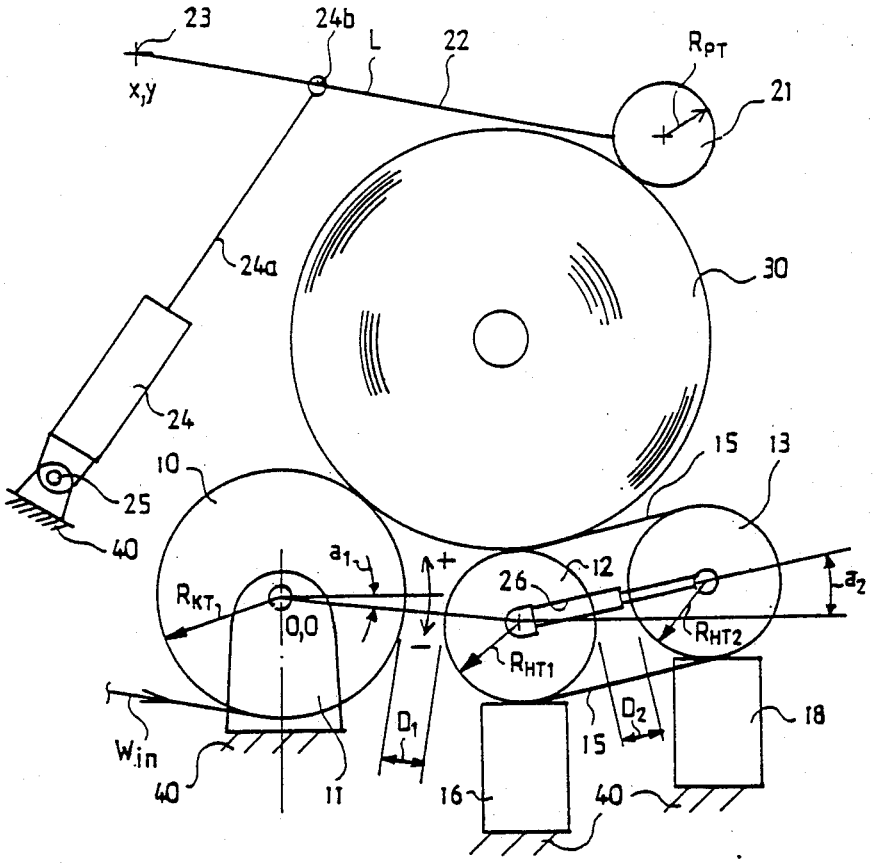
FIG. 3 illustrates essential quantities and parameters related to geometry and statics of the reeling-up and of support of a reeled-up roll in accordance with the present invention.

With reference to FIG. 3, a radius $R_{KT}$ of the rear carrier roll 10 must be chosen in accordance with width and running speed of the machine. As a rule, $R_{KT}$=about 500 to 1000 mm, preferably about 500 to 850 mm. The bending of the belt 15 and the durability of the bearings determine the radius $R_{HT1}$ of the belt roll 12. As a rule, $R_{HT1}$ is roughly equal to about 300 to 600 mm, preferably about 400 mm. The radius $R_{HT2}$ of the second belt roll 13 may be the same as $R_{HT1}$. The radius $R_{PT}$ of the press roll 21 is determined by the radius of the core 31 and by $R_{KT}$ and $R_{HT1}$, with $R_{PT}$ being roughly equal to about 100 to 500 mm, preferably about 200 to 300 mm. An articulation point x, y of the press roll 21 and a length L of the arm 22 thereof, are determined so that it is possible to load and support the roll 30.

Distance $D_1$ between the carrier roll 10 and the roll 12 is determined in accordance with the core 31, with the rolls 10 and 12, and with the press roll 21 so that it is possible to load the core 31 ($\phi$90) $D_1$ is roughly equal to about 10 to 50 mm, preferably about 30 mm. An angle $a_1$ of the roll 12 relative to the carrier roll 10 determines the diameter with which the belt 15 starts supporting the roll 30. A large positive angle $a_1$ causes a high nip load at the rear roll 10 (the weight of the roll tilts rearwardly). A large negative angle $a_1$ causes a need to load too much by means of the press roll 10. The angle $a_1$ is preferably within the range of about $-20° < a_1 < 20°$.

An angle $a_2$ of the roll 13 relative to the roll 12, together with $D_2$, namely the distance between these rolls 12 and 13, determine the maximum diameter $2R_0$ of the roll 30. If the roll 13 is shifted during running, then angle $a_2$ also effects direction of the supporting force of the belt 15 during running and consequently, the form of the tensioning function. The belt rolls 12 and 13 are shifted for the purpose of adjusting the tensioning T of the belt 15 in a plane which forms an angle $a_2$ with the horizontal plane, and which is within the range of about 0° to 45°, preferably about 5° to 20°.

Figure 2A:
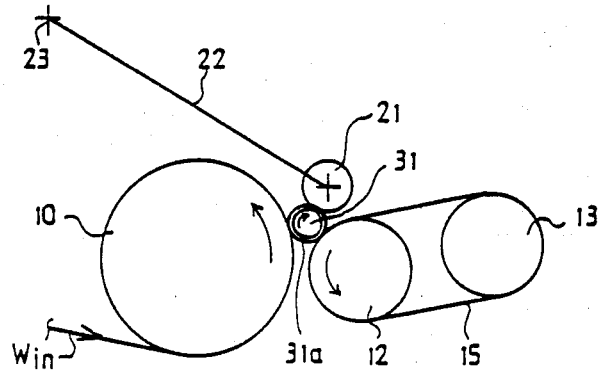
FIGS. 2A, 2B and 2C illustrate different stages in the reeling-up in accordance with the present invention with different reeled-up roll diameters.
Figure 2B:
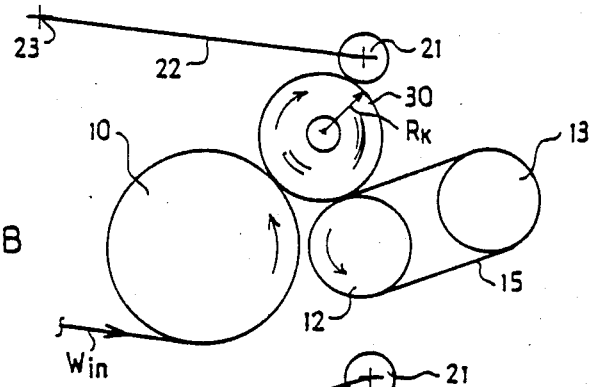

FIGS. 1A and 2A illustrate the start of reeling. The core 31 onto which the roll 30 is reeled, is brought by means of a core lock 31A into a space between the rolls 10, 12 and 21 so that these rolls form supporting nips for the core and for the roll 30 that is about to begin its growth. As is illustrated in FIG. 2B, a diameter $2xR_k$ of the roll 30 has increased to about 400 to 700 mm. The distribution of the nip pressure in the nip 10/30 thereat in a direction S of the circumference of the roll, is $p_{kt2}$ (FIG. 4), and the nip pressure in the extended nip 30/12, 15 is $p_{ht2}+p_{h2}$ (FIG. 4), so that the belt 15 has started carrying the roll 30 from below on its portion $S_{h2}$, and the length of the nip in the direction S of the circumference has increased. The length of the nip 10/30 has also increased from the length $S_{k1}$ or the initial situation, to the length $S_{k2}$, at the same time that the peak pressure $p_{maxk1}$ has dropped to a peak pressure value $p_{maxk2}$, and distribution of pressure has dropped from $p_{kt1}$ to $p_{kt2}$.

Figure 2C:
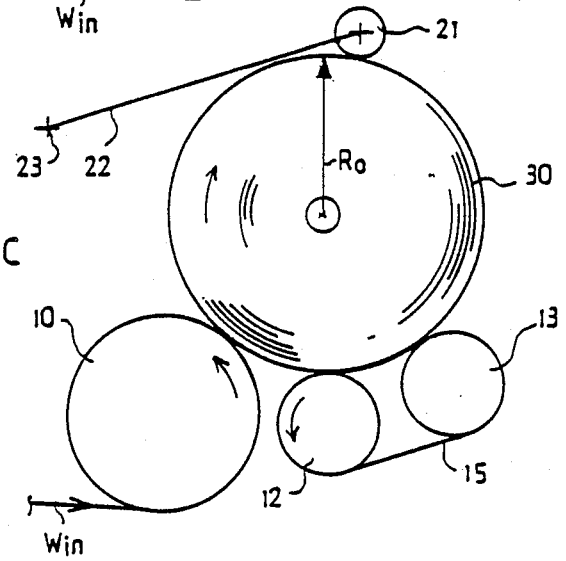
Figure 4:
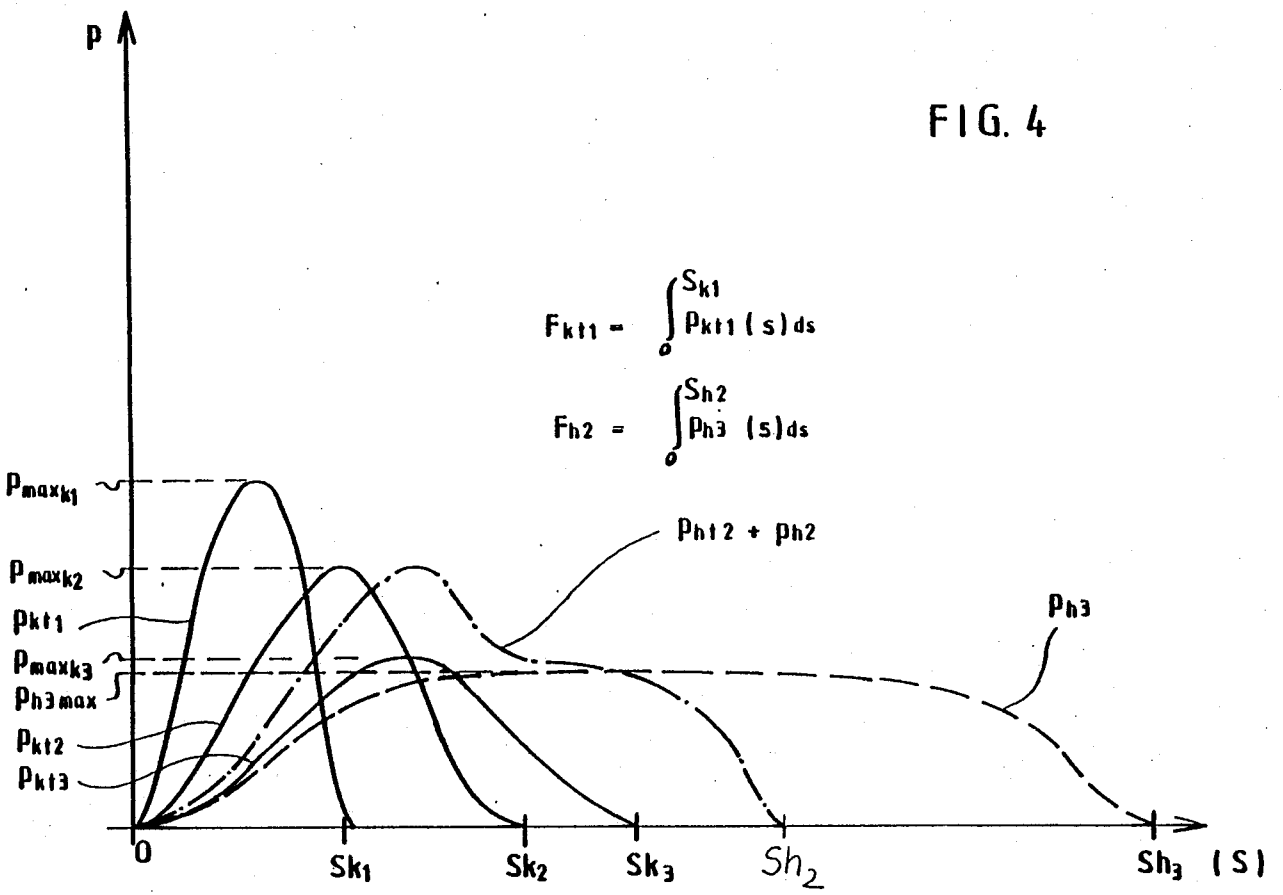
FIG. 4 is a graphical illustration of distribution of pressures in the different support nips in a direction of circumference of a roll being reeled up in accordance with the invention herein.

As shown in FIG. 2C, the roll 30 has increased to its full diameter $2xR_0$, whereby the length of the nip 10/30 has increased in accordance with FIG. 4, due to the increase in the radius of the roll 30, to a length $S_{k3}$ while the peak pressure has dropped to a peak pressure value $p_{maxk3}$ and the distribution of nip pressure has dropped to $p_{kt3}$. At the same time, length of the supporting zone of the belt unit 12, 15, 13 has increased to its full length $S_{h3}$, and the distribution of pressure $p_{h3}$ is evenly flat at a peak pressure of $p_{h3max}$. In the final stages of the reeling, when the radii of the roll 30 are close to the radius $R_o$ of a completely-wound roll, the roll 30 is supported by means of the belt support unit 20 in such a manner that the outer circumference of the roll 30 is situated close to the outer belt roll 13, or forms a nip of a low linear load with the outer belt roll 13.

It should be emphasized that FIG. 4 is an illustration of a principal concerning distribution of pressures and does not necessarily show different distributions, pressure values, or lengths S of supporting nips in compliance with reality.

Geometry and statics of the reelings in accordance with the present invention will be described below, with reference to the notations in FIG. 1B. In static examination, roll weight G and the vertical component of the linear load $F_{pt}$ of the press roll 21 are supported by vertical components of the linear load $F_{kt}$ of the carrier-roll nip 10/30, the linear load $F_{ht}$ of the first belt roll 12, and of the linear load $F_h$ caused by the tensioning T (N/m) of the belt 15. The roll 30 and the second belt roll 13 do not necessarily form a loaded nip. A corresponding static equilibrium prevails with respect to the horizontal components of the linear loads $F_{kt}$, $F_{ht}$, $F_h$, $F_{pt}$. The geometry and statics of the system as well as the linear loads which are optimal in view of the reeling, keep changing all the time as the radius R of the roll increases.

Distribution of density of the roll 30 as a function of the radius R is principally determined by the distribution $F_{kt}(R)$ of the linear load of the rear carrier roll 10. This is, above all, due to the fact that the web $W_{in}$ is introduced onto the roll 30 exactly through the rear-roll nip 10/30. As a rule, an invariable density of the roll 30 as a function of the radius R is intended. The linear load $F_{kt}$ in the nip 10/30 thereat, must be slowly rising along with the growth of the radius. With different paper qualities, the linear load $F_{kt}$ in the nip 10/30 must be at different levels and the steepness of the change as a function of the radius R is preferably variable.

Linear loads $F_{pt}$ and $F_{ht}$ of the roll 21 which contacts the roll 30 directly and of the first belt roll 12 which contacts the roll 30 through the belt 15, must be within certain limits, of which the lower limit is determined by the fact that the roll 30 must be adequately and stably supported during the reeling, and the upper limit determined by the fact that the rolls 12 and 21 must no sink into the roll 30 to a disturbing extent.

The bearing supports **14*a* and 14*b* of the belt rolls 12 and 13 are interconnected by means of a pair 26 of hydraulic cylinders, the direction of movement thereof being substantially parallel to a direction of run of the belt 15 between the rolls 12 and 13. By passing a controlled pressure pt into the cylinders 26, it is possible to adjust the tension T of the belt 15. The pressure load caused by the tension T on the outer circumference of the roll 30 in the radial direction of the roll 30 can, in principle, be calculated from the formula $p=T/R$, so that this pressure load is also affected by the radius R of the roll 30, in addition to the effect of changes in geometry of the support. Tensioning of the belt or belts 15 can be effected substantially in a direction of a plane passing through axes of rotation of the belt rolls 12, 13**.

The control of the reeling is governed by the measurement of the radius R of the roll 30 or of any other equivalent quantity, because the geometry and the statics of the support and formation of the roll 30 depend on the radius R or equivalent. According to FIG. 1B, the radius R is measured by means of a revcounter 120 of the carrier roll 10 and by means of a revcounter 130 of the core lock **31*a*, the signals $r_1$ and $r_2$ thereof being passed to a central unit 100. The weight G of the roll 30 can also be derived directly from the signal $r_1$ and $r_2$, if the grammage of the web W to be reeled has been fed to the system 100. In order to ensure the operation, the radius R of the roll is also measured by means of measurement of the angle a of the loading arms 22 of the press 21, which is accomplished by means of the unit 110. From this measurement, it is possible to calculate the radius R of the roll, the corresponding signal a being passed to the central unit 100**.

The central unit 100 is either a controllable logic unit or a computer in which the values of the adjustment quantities $p_k$ and $p_t$ of the system as a function of the radius R of the roll 30 or equivalent, such as weight or the like, have been stored as tables or as functions, separately for each of the different quality groups and for the individual qualities in the groups as modified, e.g., by mean of correction factors.

In the accompanying Table 1, the roll weight, the linear loads $F_{pt}$, $F_{kt}$, $F_{ht}$ and $F_h$, the pressure $p_t$, and the belt tension T are given at the values of 100 to 1500 mm of the roll diameters 2R with steps of 100 mm. The objective of Table 1 is to illustrate a preferred exemplary embodiment of the invention. The web W to be reeled is a SC or LWC paper of a density of about 1200 kg/m$^3$, while the length of the roll is about 3.6 m.

The data given in Table 1 are stored in a memory of the programmable logic unit or computer included in the central unit 100 as a table or as functions. When the species is changed, new tables or functions stored in the memory can be taken into use, or the values of the preceding tables or functions can be modified by means of certain correction factors, which are obtained either from the program or from the unit 100.

From Table 1 as well as from FIG. 4, the following can be noted. The weight G of the roll increases naturally in proportion to the second power of the radius R. As can be concluded from the column $F_{kt}$, the linear load $F_{kt}$ is increased substantially evenly as the radius grows. An invariable distribution of density in the roll 30 is hereby an intended objective.

The tension T of the carrier belt 15 has a certain upper limit in consideration of the strength of the belt 15. This upper limit is not permitted to be exceeded in any situation, by the control system. The linear load $F_{pt}$ of the press roll 21 dominates the roll control with smaller radii R, while with larger radii R the linear load $F_{pt}$ of the press roll 21 is lowered because the weight G of the roll 30 is increasing.

According to the invention, when the tension T of the belt 15 is used as the principal control quantity with larger roll diameters of $2R>500$ mm, the linear load $F_{kt}$ can be controlled and the linear loads $F_{ht}$ and $F_{pt}$ can be kept within the permitted limits which are determined by geometry of the reel-up and by the web W to be reeled. A further advantage is that therein, when a sufficiently long ($S_{h3}$, FIG. 4) nip sector between the rolls 12 and 13 is used, the surface pressure ($p_{h3max}$, FIG. 4) caused by the linear load $F_h$ between the outer circumference S of the roll 30 and the tensioned belt 15 never becomes higher than permitted. With respect to this surface pressure, it is always possible to operate within an advantageous and safe area.

It should also be pointed out that the pressure $p_k$ in the relieving cylinders 24 of the press roll 21, can also be adjusted on the basis of tables and/or functions stored in the memory of the control system 100. In a preferred embodiment, the belt support unit 20 comprises two and only two belt rolls 12, 13, between which there are power units, preferably hydraulic cylinders 26, arranged in such a way that adjustment of the tensioning T of the belt or belts 15 has no substantial effect on the length of the support zone of the belt unit 20 or on the form of the distribution of the support pressure.

The preceding description of the present invention is merely exemplary, and is not intended to limit the scope thereof in any way.

TABLE I

| 2R mm | G kg/3.6 m | $F_{pt}$ kN/m | $F_{kt}$ kN/m | $F_{ht}$ kN/m | $F_h$ kN/m | $P_k$ bar | $P_t$ bar | T kN/m |
|---|---|---|---|---|---|---|---|---|
| 100 | 34 | 1.20 | 1.46 | 1.29 | 0.00 | 41.88 | 95.49 | 20.00 |
| 200 | 136 | 1.45 | 1.55 | 1.18 | 0.00 | 32.37 | 95.49 | 20.00 |
| 300 | 305 | 1.40 | 1.59 | 1.35 | 0.00 | 32.75 | 95.49 | 20.00 |
| 400 | 543 | 1.45 | 1.65 | 1.81 | 0.00 | 33.30 | 95.49 | 20.00 |
| 500 | 848 | 1.45 | 1.70 | 1.96 | 0.56 | 33.82 | 95.49 | 20.00 |
| 600 | 1221 | 1.45 | 1.77 | 1.41 | 2.03 | 32.27 | 100.27 | 21.00 |
| 700 | 1663 | 1.45 | 1.85 | 1.29 | 3.27 | 30.65 | 100.27 | 21.00 |
| 800 | 2171 | 1.43 | 1.89 | 1.40 | 4.49 | 30.38 | 102.65 | 21.50 |
| 900 | 2748 | 1.40 | 1.90 | 1.62 | 5.79 | 31.27 | 107.43 | 22.50 |
| 1000 | 3393 | 1.40 | 1.95 | 1.83 | 7.30 | 29.00 | 114.59 | 24.00 |
| 1100 | 4105 | 1.30 | 2.00 | 1.85 | 9.12 | 28.71 | 124.14 | 26.00 |
| 1200 | 4886 | 1.10 | 2.03 | 1.94 | 10.97 | 32.88 | 131.30 | 27.50 |
| 1300 | 5734 | 0.65 | 2.08 | 1.82 | 12.99 | 41.99 | 137.03 | 28.70 |
| 1400 | 6650 | 0.01 | 2.12 | 2.20 | 14.53 | 52.30 | 133.69 | 28.00 |
| 1500 | 7634 | 0.01 | 3.34 | 2.35 | 16.25 | 49.80 | 123.19 | 25.80 |

What is claimed is:

1. Method for reeling a web into a roll, comprising the steps of winding the web about a core between the same and a carrier roll, which forms a reeling nip, and a belt roll, to form a web roll being wound, continuing said winding of the web about the core between the same and the carrier roll, and additionally, after the web wound upon the core reaches a certain radius, between the core and a belt supporting zone situated as a direct extension of the belt roll, passing the web over a sector of the carrier roll to the core, providing nip support to the web roll being wound from underneath by the carrier roll and by the belt roll, and then by the belt supporting zone when the roll reaches a certain radius, and stabilizing the web roll in reeling position by winding the web about the core between the same and an upper press member wherein the upper press member is a press roll, continuing said winding of the web between the core and said belt supporting zone whereby the radius of the wound roll increases and tension of at least one belt defining said supporting zone is adjusted by means control system, whereby linear loads in nips formed between the roll being wound and the carrier roll, the upper press member, and the belt zone are maintained within suitable limits, and in the final stages of reeling, supporting the roll being wound by the belt supporting zone after the winding of the web roll is almost completed, such that an outer circumference of the wound roll is placed close to a second belt roll around which the at least one belt forming the supporting zone passes, thus extending the belt support zone such that the outer circumference of the wound roll forms a nip of low linear load with the second belt roll.

2. The method of claim 1 wherein the tension of the at least one belt is adjusted by shifting opposite belt rolls about which the belt runs relative to one another.

3. The method of claim 2, wherein the belt rolls are shifted by means of at least one power unit with a direction of effort substantially parallel to a principal direction of run of the belt between the belt rolls.

4. The method of claim 3, wherein said substantially parallel direction forms an angle with a horizontal plane of about 0° to 45°.

5. The method of claim 4, wherein said angle is about 5° to 20°.

6. Method for reeling a web into a roll, comprising the steps of winding the web about a core between the same and a carrier roll and a belt roll, the form a web roll being wound, continuing said winding of the web about the core between the same and the carrier roll, and additionally, after the web wound upon the core reaches a certain radius, between the core and a belt supporting zone situated as a direct extension of the belt roll, passing the web over a sector of the carrier roll to the core, supporting the web roll being wound from underneath by the carrier roll and by the belt roll, and then by the belt supporting zone when the web roll reaches the certain radius, stabilizing the web roll in reeling position by winding the web about the core between the same and an upper press member, and measuring radius of the roll that is being wound by at least one of a resolution detector on the carrier roll, a revolution detector on the core, and a position detector for a supporting member for the upper press member, passing signals from a respective detector to a control system, and then adjusting tension of the at least one belt based on predetermined values stored in a memory of the control system.

7. The method of claim 6, comprising the additional step of adjusting pressure in a cylinder loading the upper press member based on the predetermined values.

8. Apparatus for reeling of a web, comprising a carrier roll arranged for supporting a roll of the web as it is being wound, a support unit arranged for supporting the roll of the web as it is being wound together with said carrier roll, said support unit comprising a pair of belt rolls and at least one belt passing around the same and arranged to support, on an upper run thereof, the roll being wound after the roll increases past a certain radius in size, and means for adjusting tensioning of said at least on belt substantially in a direction of a plane passing through axes of rotation of said belt rolls and arranged between said belt rolls which are provided in a vicinity of the roll being formed.

9. The combination of claim 8, additionally comprising said carrier roll being arranged to guide the web over a sector thereof and to a point where the web roll is being wound, and to form a nip with the web roll being wound, and a press member arranged to stabilize the web roll in position as it is being wound.

10. The combination of claim 9, wherein the press member comprises a press roll arranged above the web roll being wound.

11. The combination of claim 8, additionally comprising a first intermediate member on which one of said belt rolls closest to said carrier roll is rotatably journaled, a second intermediate member on which the other of said belt rolls is rotatably journaled, a third intermediate member articulatingly joining said first and second intermediate members.

12. The combination of claim 11, wherein said power unit comprise a pair of hydraulic cylinders.

13. The combination of claim II, additionally comprising an hydraulic cylinder supporting said second intermediate member on a stationary structure, whereby said other of said belt rolls can be displaced.

14. The combination of claim 11, wherein said power unit comprises a cylinder and rod arrangement with said cylinder coupled to said belt roll closest to said carrier roll and said rod coupled to said other belt roll.

15. The combination of claim 8, additionally comprising several belts arranged side-by-side.

16. The combination of claim 8, wherein two and only two said belt roll are provided and arranged along with said adjusting means to maintain a support zone for the web roll being wound and distribution of support pressure substantially unaffected by adjusting the tension of said belt.

17. The combination of claim 8, wherein said adjusting means are articulatingly coupled to both said belt rolls and extend in a direction of said plane substantially parallel to a run of said belt between said belt rolls.

18. The combination of claim 8, wherein said adjusting means comprise a rod and cylinder arrangement.

19. The combination of claim 18, wherein said cylinder is coupled to one of said belt rolls closest to said carrier roll and said rod is coupled to the other of said belt rolls.

* * * * *